US007255432B2

(12) United States Patent
Lui

(10) Patent No.: US 7,255,432 B2
(45) Date of Patent: Aug. 14, 2007

(54) INK CARTRIDGE

(75) Inventor: Pui-Kuong Lui, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 360 days.

(21) Appl. No.: 11/092,657

(22) Filed: Mar. 30, 2005

(65) Prior Publication Data

US 2006/0227188 A1 Oct. 12, 2006

(51) Int. Cl.
*B41J 2/175* (2006.01)

(52) U.S. Cl. ..... 347/86

(58) Field of Classification Search ..... 347/85, 347/86, 87; 137/87.04; 251/175, 331; 222/387, 222/389, 399
See application file for complete search history.

(56) References Cited

U.S. PATENT DOCUMENTS 4,628,333 A * 12/1986 Terasawa ..... 347/87
5,764,259 A * 6/1998 Nakajima ..... 347/86
5,988,803 A * 11/1999 Komplin et al. ..... 347/86
6,367,666 B1 * 4/2002 Hou et al. ..... 222/386.5
6,722,762 B2 * 4/2004 Miyazawa et al. ..... 347/86
6,783,219 B2 8/2004 Lui et al.
6,945,641 B2 * 9/2005 Sakai et al. ..... 347/86
6,966,639 B2 * 11/2005 Martinez-Pacheco ..... 347/86
6,976,753 B2 * 12/2005 Kuwabara et al. ..... 347/86
7,108,361 B2 * 9/2006 Kitabatake et al. ..... 347/86

* cited by examiner

*Primary Examiner*—Anh T. N. Vo
(74) *Attorney, Agent, or Firm*—Rosenberg, Klein & Lee

(57) ABSTRACT

An ink cartridge includes a hollow ink tank body, a cover member connected to the hollow ink tank body, a hollow tube and a pressure regulator arranged inside the hollow ink tank body. The cover member has an air vent penetrating therethrough, and a first through-hole protrusion adjacent to the air vent and extending forwards the hollow ink tank body. The pressure regulator includes a holder, a resilient member arranged inside the holder, an elastic plate connected to the resilient member and abutting against the holder, a secure member disposed over the elastic plate, and a thin film covered the secure member. The pressure regulator further has a through-hole projection extending outwardly therefrom for connecting the hollow tube that connects to the first through-hole protrusion of the cover, so that the atmospheric air passes through the pressure regulator via the hollow tube after a sealing film is removed.

17 Claims, 7 Drawing Sheets

INK CARTRIDGE

BACKGROUND OF THE INVENTION

1. Field of the Invention

The present invention relates to an ink cartridge adapted for an ink jet printer, and particularly relates to an ink cartridge that can improve the ink leakage problem at both the inlet and outlet of ink cartridge.

2. Background of the Invention

The ink jet recording technology is such as to record characters and images directly on a recording medium (such as paper, cloth, or plastic sheet) by discharging ink from fine nozzles thereto. Conventionally, the recording apparatus has been utilized as a printer serving and provided as the output terminal of a copying machine, a facsimile equipment, a printer, a word processor, a work station or the like; or as a handy or portable printer used for such an information processing system as a personal computer, a host computer, an optical disc device or a video apparatus. In a conventional recording apparatus, ink is supplied to a recording head from an ink tank constructed as a cartridge.

Although increasing the negative pressure prevents ink from seeping out of the recording head, the negative pressure has an upper limit. If the negative pressure is too high, ink cannot overcome the negative pressure and jet from the recording head. On the other hand, the ink cartridge must be able to adjust the negative pressure in the ink tank automatically by keeping the negative pressure during a suitable range. U.S. Pat. No. 6,783,219 B2, entitled "Ink Cartridge", one of the relative documents, provides an elastic member for unidirectional ventilation by a pressure difference between inside and outside the hollow ink tank body without both air inlet hole and porous member. A pressure regulator referred in the prior art is used to maintain the pressure and the ink flows to the printhead continuously. Nevertheless, ink leakage problems of the pressure regulator may occur during storage, delivery and printing operation. Alternatives of regulator pressure have been explored but have failed to adequately address the leakage issue.

It is desirable to develop a new and improved ink cartridge to substantially resolve the leakage problems and provide better, more advantageous overall results.

SUMMARY OF INVENTION

An ink cartridge adapted for an ink jet printer is provided for preventing the ink leakage problem of ink cartridge.

The ink cartridge adapted for an ink jet printer is provided with a pressure regulator arranged inside the ink cartridge and communicating with the atmospheric air via an upper air vent formed on a cover and a hollow tube connecting the air vent, so that the atmospheric air communicates with internal cartridge effectively while printing.

The ink cartridge adapted for an ink jet printer is provided with an ink supply assembly that has a small bell-shaped plug with a center slot and a resilient member locked to the plug, so that the ink supply assembly is secured elastically and prevent the ink from leaking out of the ink supply assembly easily.

An ink cartridge is disclosed, and includes a hollow ink tank body, a cover member, a hollow tube and a pressure regulator. The hollow ink tank body defines a cavity therein and an outlet port formed on a bottom thereof. The cover member is connected to a top of the hollow ink tank body; and has an air vent penetrating therethrough, and a first through-hole protrusion adjacent to the air vent and extending forwards the cavity of the hollow ink tank body. The hollow tube is connected to the first through-hole protrusion of the cover. The pressure regulator is arranged inside the cavity of the hollow ink tank body and connected to the hollow tube. The pressure regulator includes a holder, a resilient member arranged inside the holder, an elastic plate connected to the resilient member and abutting against the holder, a secure member disposed over the elastic plate, and a thin film covered the secure member. The pressure regulator further has a through-hole projection extending outwardly from the holder and the secure member in an alternative manner, for communicating with an inside of the holder and connecting the hollow tube, so that the atmospheric air passes through the pressure regulator via the hollow tube after a sealing film is removed.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
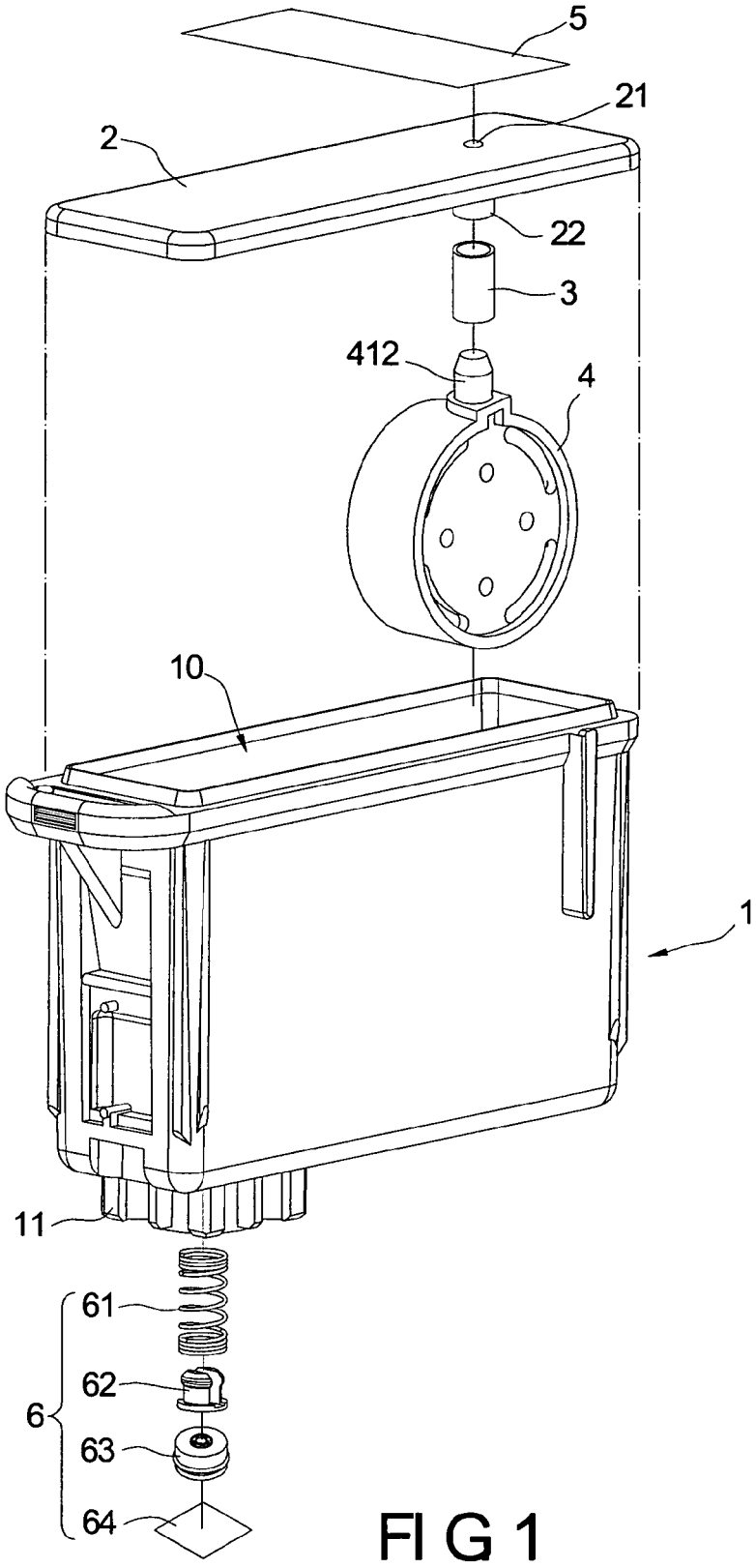
FIG. 1 is a decomposition view of an ink cartridge according to the present invention.

Referring to FIG. 1, an ink cartridge according to an embodiment of the present invention includes a hollow ink tank body 1, a cover member 2, a hollow tube 3, a pressure regulator 4, a sealing film 5 enclosing the cover member 2, and an ink supply assembly 6. The hollow ink tank body 1 defines a cavity 10 therein for filling with ink and an outlet port 11 formed on a bottom thereof for delivering the ink outwards. The cover member 2 is connected to a top of the hollow ink tank body 1; and has an air vent 21 penetrating therethrough, and a first through-hole protrusion 22 adjacent to the air vent 21 and extending forwards the cavity 10 of the hollow ink tank body 1. The sealing film 5 encloses the air vent 21 of the cover member 2 before use. The hollow tube 3 is connected to the first through-hole protrusion 22 of the cover member 2 via an end thereof. In addition, the hollow tube 3 can be made of flexible or rigid materials, so that the hollow tube 3 can be folded or straightly disposed in the cavity 10 of the hollow ink tank body 1.

Figure 2:
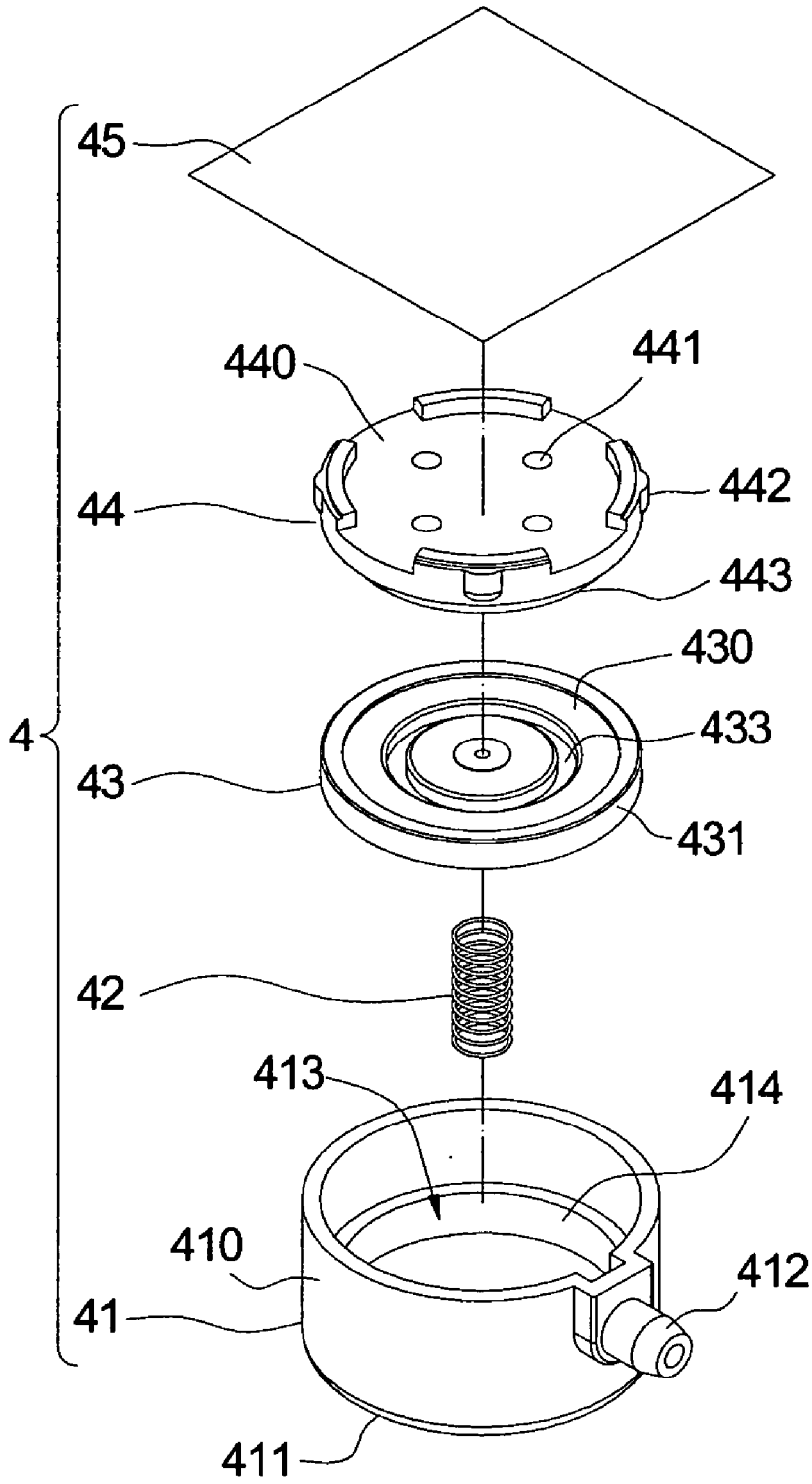
FIG. 2 is a decomposition view of a pressure regulator of the ink cartridge according to the present invention.
Figure 2A:
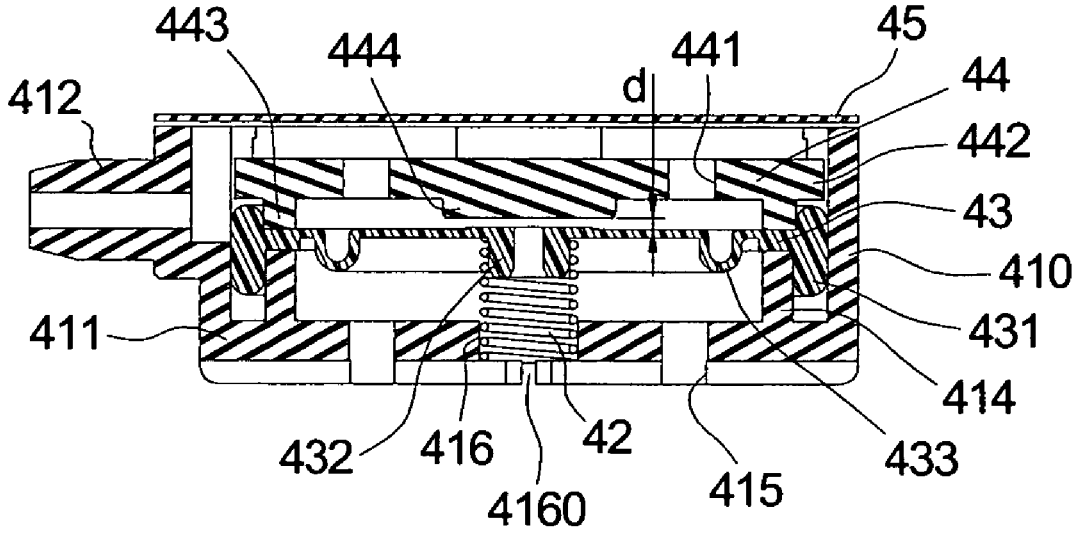
FIG. 2A is a cross-sectional profile of the pressure regulator of the ink cartridge according to the present invention.
Figure 2B:
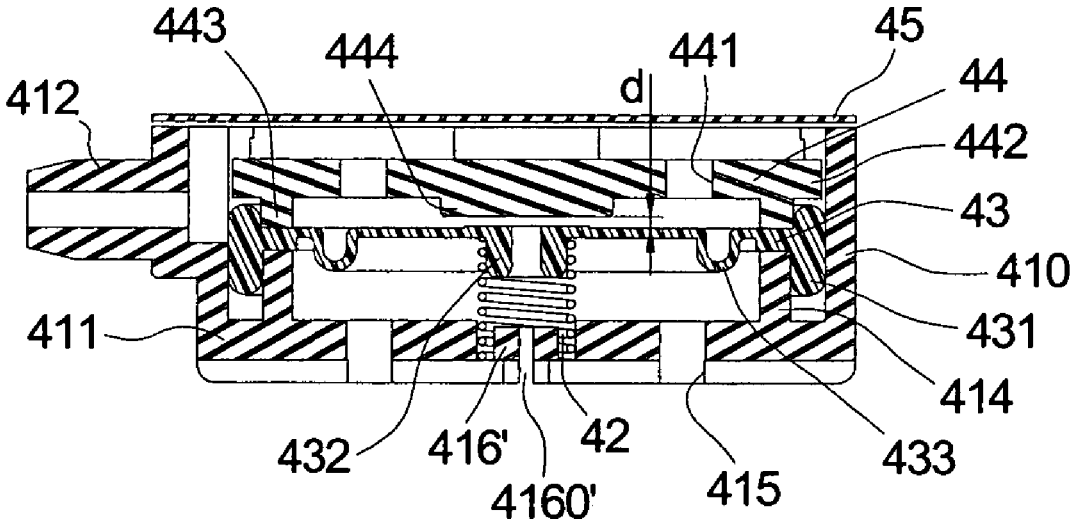
FIG. 2B is a cross-sectional profile of the pressure regulator of the ink cartridge according to the present invention due to another embodiment of a holder.
Figure 2C:
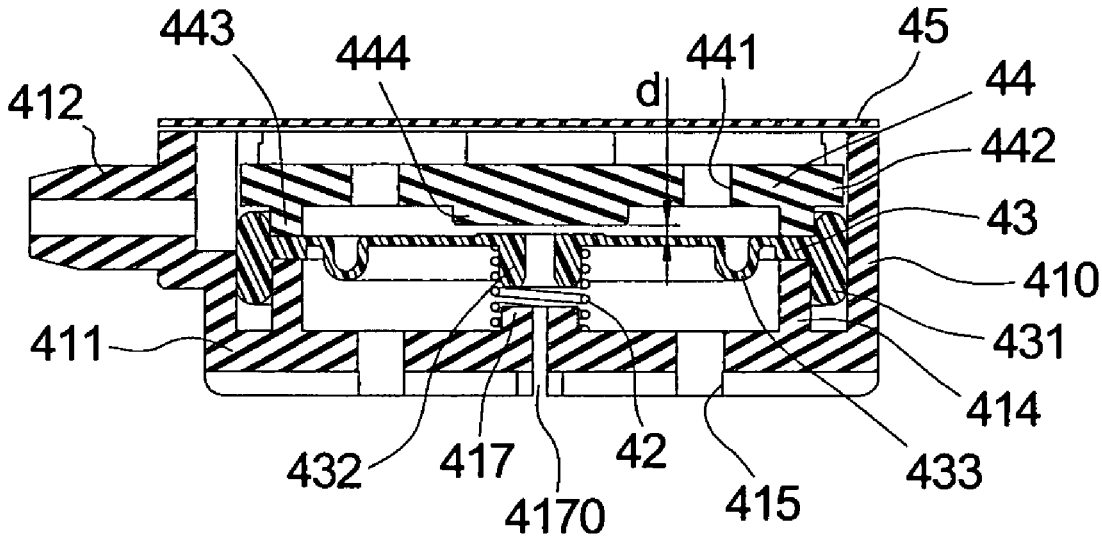
FIG. 2C is a cross-sectional profile of the pressure regulator of the ink cartridge according to the present invention due to a further embodiment of the holder.
Figure 2D:
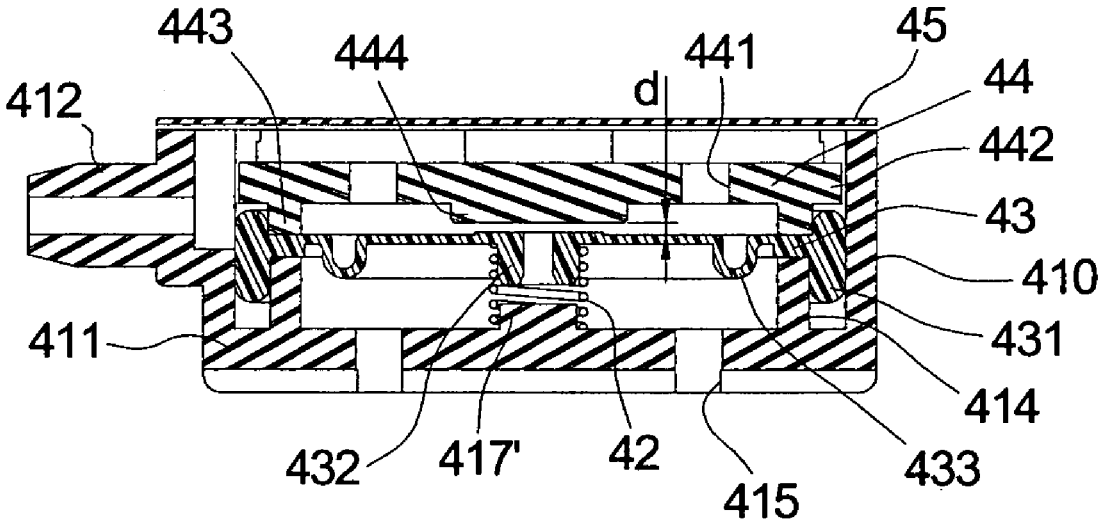
FIG. 2D is a cross-sectional profile of the pressure regulator of the ink cartridge according to the present invention due to an additional embodiment of the holder.

The pressure regulator 4 is arranged inside the cavity 10 of the hollow ink tank body 1 and connected to an opposite end of the hollow tube 3. Illustrated in FIGS. 2 and 2A, the pressure regulator 4 includes a holder 41, a resilient member 42 arranged inside the holder 41, an elastic plate 43 connected to the resilient member 42 and abutting against the holder 41, a secure member 44 disposed over the elastic plate 43, and a thin film 45 covered the secure member 44. The holder 41 includes a peripheral wall 410, a bottom wall 411 connected with the peripheral wall 410, a first through-hole projection 412 extending outwardly from the peripheral wall 410 thereof and communicating with an inside 413 thereof, and a partition wall 414 disposed to the bottom wall 411 annually and adjacent to the peripheral wall 410 for engaging a circular flange 431 of the elastic plate 43 therebetween. The first through-hole projection 412 connects the hollow tube 3 so that the atmospheric air passes through the pressure regulator 4 via the hollow tube 3 after the sealing film 5 is removed. The holder 41 further includes a plurality of holes 415 penetrated therethrough for communicating with the pressure regulator 4 and the cavity 10 of the hollow ink tank body 1. Illustrated in FIG. 2A, the holder 41 can define a recess 416 formed on the bottom wall 411 and a hole 4160 penetrating the bottom wall 411. The hole 4160 corresponds to the recess 416 for communicating with the pressure regulator 4 and the cavity 10 of the hollow ink tank body 1. An end of the resilient member 42 can be located in the recess 416 for orientation and another end of that is fitted with a protrusion 432 of the elastic plate 43. Illustrated in FIG. 2B, the holder 41 can define an annular recess 416' formed on the bottom wall 411 and a hole 4160' penetrating the bottom wall 411. The hole 4160' corresponds to the annular recess 416' for communicating with the pressure regulator 4 and the cavity 10 of the hollow ink tank body 1. An end of the resilient member 42 can be located inside the annular recess 416' for orientation. In another embodiment, the holder 41, illustrated in FIG. 2C includes a second through-hole protrusion 417 extending from the bottom wall 411 upwardly and a hole 4170 penetrating the bottom wall 411. The hole 4170 corresponds to the second through-hole protrusion 417 for communicating with the pressure regulator 4 and the cavity 10 of the hollow ink tank body 1. An end of the resilient member 42 can be sleeved on the second through-hole protrusion 417. In a further embodiment, the holder 41, illustrated in FIG. 2D according to the present invention, has a real pillar 417' extending from the bottom wall 411 upwardly so that the resilient member 41 is sleeved on the real pillar 417'. The resilient member 42 can be a spring that has two ends connected to the holder 41 and the elastic plate 43 respectively. Another embodiment of the resilient member 42 will not be restricted. The elastic plate 43 of the pressure regulator 4 includes a plate body 430, the flange 431 disposed to a circumstance of the plate body 430 and engaged with the partition wall 414 and the peripheral wall 410 of the holder 41, the protrusion 432 corresponding to and sleeved with the resilient member 42 for orientation, and a circular concave portion 433 arranged between the protrusion 432 thereof and the partition wall 414 of the holder 41. The secure member 44 includes a secure body 440, a plurality of holes 441 penetrated through the secure body 440, a plurality of projections 442 rising laterally from a circumference of the secure body 440 in order to retain against the peripheral wall 410 of the holder 41, and a sustaining wall 443 extending from the secure body 440 downwardly to abut against the elastic plate 43. Particularly, the sustaining wall 443 abuts against the plate body 430 and locates between the circular concave portion 433 and the flange 431. The secure member 44 further includes a bulge 444 disposed to a lower surface of the secure body 440 and corresponding to the resilient member 42 but remaining a predetermined distance "d" spaced from the elastic plate 43. The bulge 444 is used for stopping the elastic plate 43 in case of rising upwards too much due to the resilient member 42, and the predetermined distance "d" provides the buffer for stretching the resilient member 42. The thin film 45 is used to bond the secure member 44 and the holder 41 together, and to cover on the secure body 440 of the secure member 44.

Figure 3:
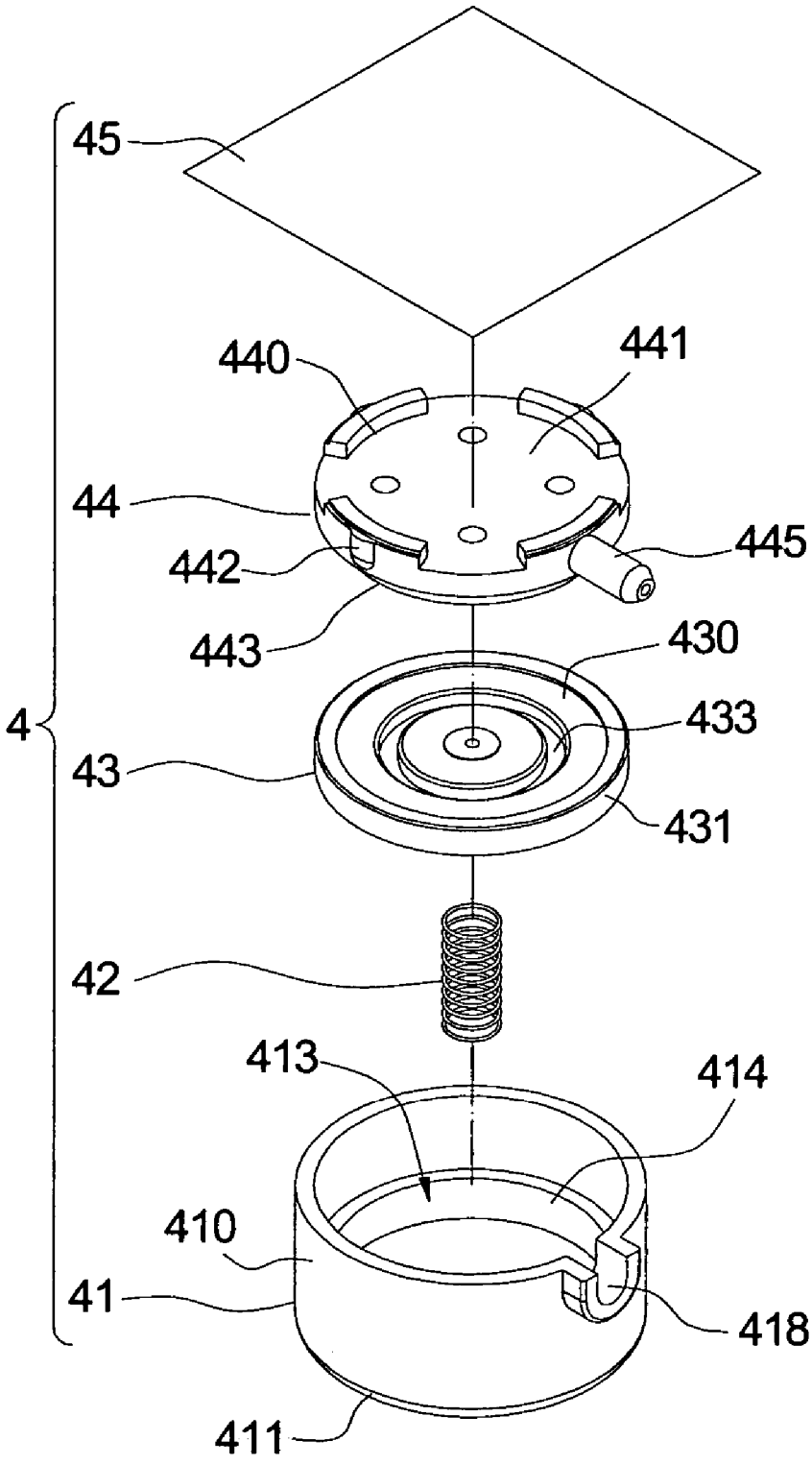
FIG. 3 is a decomposition view of the pressure regulator of another embodiment of the ink cartridge according to the present invention.

Another embodiment relative to both the holder 41 and the secure member 44 according to the present invention is illustrated in FIG. 3. The holder 41 includes the peripheral wall 410, the bottom wall 411 connected with the peripheral wall 410, a concaved opening 418 formed on the peripheral wall 410, the cavity circumstanced by the peripheral wall 410 and the bottom wall 411, and the partition wall 414 disposed to the bottom wall 411 annually and adjacent to the peripheral wall 410. The secure member 44 includes the secure body 440, the holes 441 penetrated through the secure body 440, the projections 442 rising laterally from the circumference of the secure body 440 in order to retain against the peripheral wall 410 of the holder 41, the sustaining wall 443 extending from the secure body 440 downwardly to abut against the elastic plate 43, and a second through-hole projection 445 extending outwardly from the secure body 440 thereof. The bulge (not shown) is still disposed to the lower surface of the secure body 440. The second through-hole projection 445 corresponds to the concaved opening 418 of the holder 41 for exposing out of the holder 41 by plugging down to the concaved opening 418.

Figure 4:
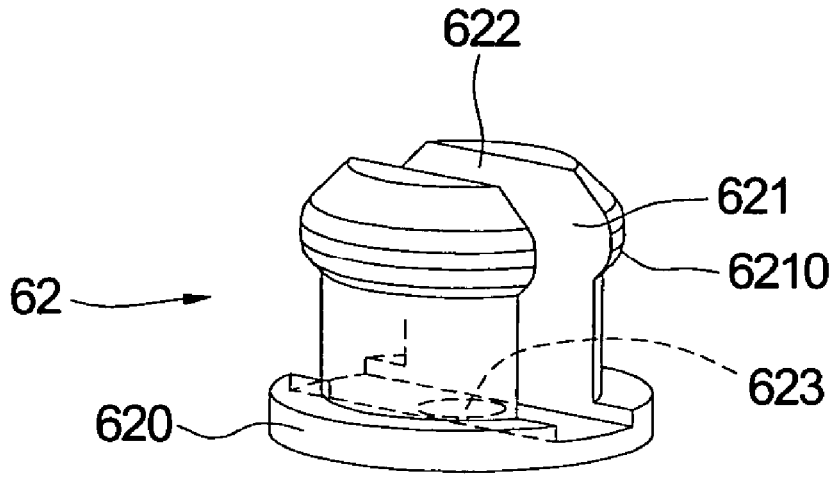
FIG. 4 is an enlarged view of a bell-shaped plug of an ink supply assembly of the ink cartridge according to the present invention.
Figure 5:
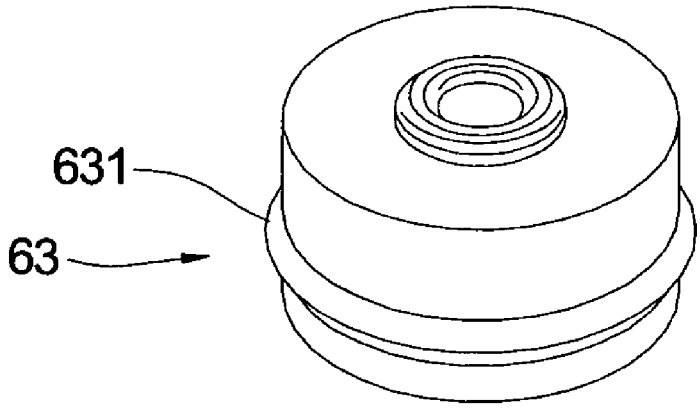
FIG. 5 is an enlarged view of a through-hole stuff of the ink supply assembly of the ink cartridge according to the present invention.

With respect to FIGS. 1, 4 and 5, the ink supply assembly 6 is arranged to the outlet port 11 of the hollow ink tank body 10. The ink supply assembly 6 includes an outlet resilient member 61, a bell-shaped plug 62 sleeved with the outlet resilient member 61, a through-hole stuff 63 disposed under the plug 61, and an outlet sealing film 64 covered the through-hole stuff 63. The bell-shaped plug 62 has a plug plate 620, two upright walls 621 disposed on the plug plate 620 and opposite to each other, a slot 622 formed between the two upright walls 621 and a vent 623 formed on the plug plate 620 for communicating with the through-hole stuff 63. Each of the two upright walls 621 has a bell-shaped projection 6210 disposed thereto to retaining against the outlet resilient member 61 for locking the ink supply assembly 6 elastically. The vent 623 formed on the plug plate 620 is one part of the path for delivering the ink outwards. The sealing film 64 can close the through-hole stuff 63, and the through-hole stuff 63 includes a flange 631 for engaging with the outlet port 11 of the hollow ink tank body 1. Therefore, the ink leakage of the ink supply assembly 6 can be prevented easily.

Figure 6:
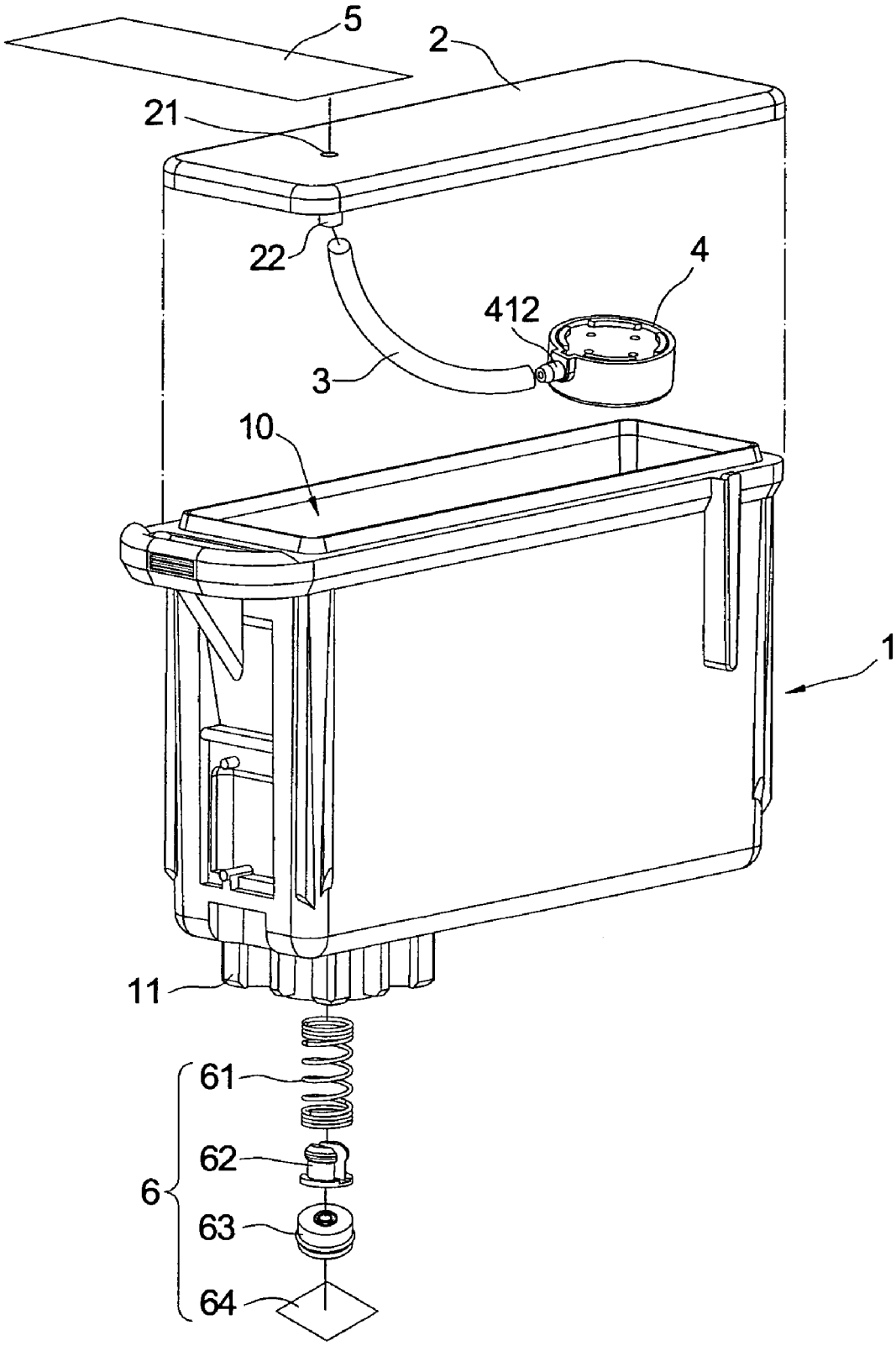
FIG. 6 is a decomposition view of another embodiment of the ink cartridge according to the present invention.

Referring to FIG. 1, the pressure regulator 4 is arranged in the cavity 10 of the hollow ink tank body 1 in a vertical manner and can be attached on a side inner wall of the hollow ink tank body 1. Alternatively, the pressure regulator 4 is arranged in the cavity 10 of the hollow ink tank body 1 in a horizontal manner illustrated in FIG. 6 and can be attached to the bottom surface of the cover member 2.

According to the present invention, the advantages of the ink cartridge are described as followed:

1. The ink cartridge adapted for an ink jet printer is provided for preventing the ink leakage problem at both the inlet and outlet of ink cartridge.

2. The ink cartridge adapted for an ink jet printer is provided with a pressure regulator arranged inside the ink cartridge and communicating with the atmospheric air via an upper air vent formed on a cover and a hollow tube connecting the air vent, so that the atmospheric air communicates with internal cartridge effectively while printing.

3. The ink cartridge adapted for an ink jet printer is provided with an ink supply assembly that has a small bell-shaped plug with a center slot and a resilient member locked to the plug, so that the ink supply assembly is secured elastically and prevent the ink from leaking out of the ink supply assembly easily.

4. The ink cartridge according to the present invention provides an alternative air ventilation method to improve the ink leakage problem during delivery, storage or printing operation. During printing, the ink flows out of a supply port and the air will then flow into the hollow ink tank body from the regulator to compensate the negative pressure inside the ink cartridge.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An ink cartridge comprising:

a hollow ink tank body defining a cavity therein, and an outlet port formed on a bottom thereof;

a cover member connected to a top of the hollow ink tank body; wherein the cover has an air vent penetrating therethrough, and a first through-hole protrusion adjacent to the air vent and extending forwards the cavity of the hollow ink tank body;

a hollow tube connected to the first through-hole protrusion of the cover; and a pressure regulator arranged inside the cavity of the hollow ink tank body and connected to the hollow tube;

wherein the pressure regulator includes a holder, a resilient member arranged inside the holder, an elastic plate connected to the resilient member and abutting against the holder, a secure member disposed over the elastic plate, a thin film, sealing the air vent, covered the secure member;

wherein the pressure regulator further includes a through-hole projection extending outwardly from the holder and the secure member in an alternative manner, for communicating an inside of the holder and connecting the hollow tube, so that the atmospheric air passes through the pressure regulator via the hollow tube after a sealing film is removed.

2. The ink cartridge as claimed in claim 1, wherein the holder of the pressure regulator includes a peripheral wall, a bottom wall connected with the peripheral wall, and a partition wall disposed to the bottom wall annually and adjacent to the peripheral wall for engaging a circular flange of the elastic plate therebetween.

3. The ink cartridge as claimed in claim 2, wherein the holder of the pressure regulator has a plurality of holes penetrated therethrough for communicating with the pressure regulator and the cavity of the hollow ink tank body.

4. The ink cartridge as claimed in claim 2, wherein the holder of the pressure regulator has a recess or an annual recess formed thereof for receiving the resilient member.

5. The ink cartridge as claimed in claim 2, wherein the through-hole projection extends outwardly from the peripheral wall of the holder.

6. The ink cartridge as claimed in claim 2, wherein the holder of the pressure regulator has a second through-hole protrusion extending from the bottom wall upwardly, the resilient member is sleeved on the second through-hole protrusion and capable of communicating with the cavity of the hollow ink tank body; alternatively, the holder of the pressure regulator has a real pillar extending from the bottom wall upwardly, the resilient member is sleeved on the real pillar.

7. The ink cartridge as claimed in claim 2, wherein the elastic plate of the pressure regulator includes a protrusion corresponding to and sleeved with the resilient member.

8. The ink cartridge as claimed in claim 7, wherein the elastic plate of the pressure regulator includes a circular concave portion arranged between the protrusion thereof and the partition wall of the holder.

9. The ink cartridge as claimed in claim 2, wherein the secure member includes a plurality of holes penetrated therethrough and a plurality of projections rising laterally from a circumference thereof in order to retain against the peripheral wall of the holder.

10. The ink cartridge as claimed in claim 2, wherein the secure member includes a sustaining wall extending therefrom downwardly to abut against the elastic plate.

11. The ink cartridge as claimed in claim 2, wherein the secure member includes a bulge disposed to a lower surface thereof and corresponding to the resilient member.

12. The ink cartridge as claimed in claim 2, wherein the peripheral wall of the holder has a concaved opening, the through-hole projection extends outwardly from the secure member and corresponds to the concaved opening, and the through-hole projection exposes out of the peripheral wall of the holder by plugging downwardly to the concaved opening.

13. The ink cartridge as claimed in claim 1, further including an ink supply assembly arranged to the outlet port of the hollow ink tank body, wherein the ink supply assembly includes an outlet resilient member, a bell-shaped plug sleeved with the outlet resilient member, a through-hole stuff disposed under the plug, and an outlet sealing film covered the through-hole stuff.

14. The ink cartridge as claimed in claim 13, wherein the bell-shaped plug has a plug plate, two upright walls disposed on the plug plate and opposite to each other, a slot formed between the two upright walls, and a vent formed on the plug plate for communicating with the through-hole stuff.

15. The ink cartridge as claimed in claim 14, wherein each of the two upright walls has a bell-shaped projection disposed thereto to retaining against the outlet resilient member for locking the ink supply assembly elastically.

16. The ink cartridge as claimed in claim 1, wherein the hollow tube is made of flexible or rigid materials.

17. The ink cartridge as claimed in claim 1, wherein the pressure regulator is arranged in a vertical or horizontal manner in the cavity of the hollow ink tank body.

* * * * *